US006092673A

United States Patent [19]

Woolnough et al.

[11] Patent Number: 6,092,673

[45] Date of Patent: Jul. 25, 2000

[54] RECEPTACLE

[75] Inventors: Andrew Charles Woolnough, Gravesend; Sydney James Harris, Winnersh, both of United Kingdom

[73] Assignee: EML Limited, United Kingdom

[21] Appl. No.: 09/031,869

[22] Filed: Feb. 27, 1998

[30] Foreign Application Priority Data

Mar. 4, 1997 [GB] United Kingdom ..... 9704441

[51] Int. Cl.[7] ..... B42F 7/00

[52] U.S. Cl. ..... 211/50

[58] Field of Search ..... 211/50, 73; 206/449, 206/45.25

[56] References Cited

U.S. PATENT DOCUMENTS

| | | | |
|---|---|---|---|
| 2,324,232 | 7/1943 | Pantalone | 211/73 |
| 2,391,285 | 12/1945 | Williamson et al. | 211/73 |
| 3,392,903 | 7/1968 | Morgan, Jr. | 211/50 |
| 3,884,410 | 5/1975 | Giesecke | 211/50 |
| 4,149,630 | 4/1979 | Transport . | |
| 4,579,232 | 4/1986 | Fedak | 211/50 |
| 4,630,731 | 12/1986 | Albery . | |
| 4,947,996 | 8/1990 | Harris | 211/50 |
| 4,962,859 | 10/1990 | Kump | 211/50 |
| 5,150,813 | 9/1992 | Harris et al. | 211/50 |
| 5,301,800 | 4/1994 | Kenney | 211/50 |
| 5,826,732 | 10/1998 | Ragsdale | 211/73 |
| 5,868,367 | 2/1999 | Smith | 211/73 |

FOREIGN PATENT DOCUMENTS

| | | |
|---|---|---|
| 0442730A1 | 8/1991 | European Pat. Off. . |
| 478143 | 1/1938 | United Kingdom . |
| 516656 | 1/1940 | United Kingdom . |
| 2078204A | 1/1982 | United Kingdom . |

*Primary Examiner*—Alvin Chin-Shue
*Assistant Examiner*—Sarah Purol
*Attorney, Agent, or Firm*—Nikolai, Mersereau & Dietz, P.A.

[57] ABSTRACT

It is known to provide a collapsible dispenser, for example leaflets and small articles, having an upstanding, elongate recess open at one end for the insertion and dispensing of such articles. However, the need to incline the recess rearwardly means that such a known receptacle is unstable unless a detachable stabilizer is secured thereto. The invention relates to a receptacle foldable to an erect configuration from a blank, the blank comprising a base having hingedly secured thereto a plurality of walls. The base includes extending therefrom a rigid member that serves to stabilize the receptacle. One of the walls includes a recess for the member so that the blank can occupy a completely flat configuration before erecting of the receptacle.

20 Claims, 3 Drawing Sheets

RECEPTACLE

BACKGROUND OF THE INVENTION

This invention relates to a receptacle of the kind known as a leaflet dispenser.

Leaflet dispensers are free standing items comprising a base portion having upstanding therefrom a generally elongate, hollow recess that is open at its upper end. Articles such as leaflets, forms, pens and flags can be stacked in the leaflet dispenser for dispensing.

Usually, the upstanding recess is inclined rearwardly relative to the vertical, to confer stability on the leaflet dispenser and to "fan" the articles stored therein, thereby making them easier to grasp for dispensing and creating an aesthetically pleasing display.

EP-A-O 442 730 discloses a leaflet dispenser of this general kind.

Leaflet dispensers are popular amongst retailers and financial institutions because they have no moving parts and are cheap to manufacture. They can be manufactured from a range of materials, including clear acrylic; and they can be tailored to articles of a particular size or shape.

It is known to provide a leaflet dispenser that can be folded from a generally flat blank having panels hingedly secured together to define the recess referred above. The blank includes a base portion having hingedly secured thereto on opposite sides a rear panel and a front panel. The front panel has hingedly secured thereto two further walls that are releasably connectable to the rear panel on hinging of the blank to form the erect recess.

This known blank suffers from the disadvantage that the center of mass of the recess when full of articles may lie outside the "footprint" of the base on the surface on which the dispenser stands. It is therefore necessary with this known dispenser to provide an extension of the base that is a separate, planar member, securable to the base. The need for this component increases the complexity of the known leaflet dispenser. There is also a danger of the separate extension member becoming lost, thereby significantly reducing the utility of the device.

SUMMARY OF THE INVENTION

According to a first aspect of the invention there is proved a receptacle comprising a base having a plurality of walls upstanding relative thereto and linked to one another to define a recess open on one side for receipt and dispensing of articles; the receptacle being formed from a blank in which the base is hingedly secured to at least a first said wall, the base including formed rigidly integrally therewith a member that in use projects from the base beyond the hinge, the first wall including a recess for receiving the member when the first wall and the base lie parallel to one another and the receptacle including one or more interconnecting walls rigidly interconnecting a pair of said walls, each interconnecting wall having a bottom edge at an obtuse angle relative to its adjacent upstanding wall whereby the said pair of walls are in use of the receptacle inclined relative to the vertical.

The advantage of including a member as part of the base means that the base extension is always available for supporting of the leaflet dispenser, and cannot become lost. The provision of a recess in the first wall conveniently permits the blank to fold completely flat when it is not in its erect configuration.

In particularly preferred embodiments, the hollow recess is open at its upper end.

The recess formed in the first wall is through-going in preferred embodiments of the invention. However, it is, equally, within the scope of the invention for the recess to extend only part-way through the first wall to receive the said member.

Preferably the base is hingedly secured to a further said wall, the further wall lying generally opposite the first said wall in use of the apparatus. The receptacle also advantageously includes third and fourth walls interconnecting the first and further walls in use of the receptacle. In particularly preferred embodiments, the third and fourth walls are respectively hingedly secured to one of the first and further walls; and releasable secured to the other of the first and further walls.

These features advantageously permit forming of the receptacle of the invention from a one-piece blank.

The receptacle conveniently includes suspension means disposed above the said member in use of the receptacle, to permit suspension of the article with the member engaging a surface to space the base from the said surface.

Thus the dispenser of the invention may be used either as a free standing item in which the weight of the dispenser and its contents are supported solely by the base; or in a suspended position in which the dispenser is in the vicinity of the base spaced from, for example, a wall or similar surface. This feature is of benefit when the dispenser is configured so that its recess is inclined rearwardly relative to the vertical, since the use of the member as a spacer permits the recess of the dispenser to adopt the same orientation relative to the vertical regardless of whether the dispenser is used in a free standing or suspended mode.

Conveniently the receptacle includes one or more connectors for linking a plurality of the receptacle together. When the receptacle includes the third and fourth walls as aforesaid, the connector preferably includes a hook-like projection protruding from one of the third and fourth walls and a recess, for receiving a hook-like projection, formed in the other of the third and fourth walls.

This arrangement advantageously permits the linking together of a plurality of the dispensers, to create an elongate display.

Conveniently the third and fourth walls lie opposite one another in use of the receptacle.

Conveniently one or more of the walls includes a recess formed therein for displaying articles stored in the receptacle. This feature advantageously provides a portion of the receptacle through which articles stored therein are highly visible. This is beneficial even when the receptacle is manufactured from a clear material.

Preferably the first wall stands up relative to the base further than the remaining walls. This feature permits articles stored in the receptacle to rest against the first wall. Preferably the entire recess of the receptacle is inclined relative to the vertical in use of the receptacle.

According to a second aspect of the invention, there is provided a blank for forming a receptacle, the blank including a first wall having a base hingedly secured thereto, the base including rigidly integrally formed therewith a member extending therefrom, and the first wall including a recess for receiving the member, thereby permitting hinging of the first wall and the base so that the member lies in the recess; and the blank including a further wall having hingedly secured thereto an interconnectable wall for rigidly engaging the first wall, each interconnectable wall having a bottom edge at an obtuse angle to its adjacent free edge to define a recess that is inclined relative to the vertical.

Conveniently the said member is generally coterminous and with and parallel to the base, thereby permitting the blank to lie completely flat when in its unfolded position.

Preferably the blank includes one or more further walls hingedly secured thereto for forming into a hollow recess open at one side for receipt and dispensing of articles.

The blank may include one or more connectors for linking the side walls to one another to define the hollow recess. It is also preferable that one or more of the further walls in hingedly secured to the base.

In particularly preferred embodiments, the further wall is hingedly secured to the base and second and third walls are hingedly secured to the further wall.

These features assist in forming a receptacle from the blank of the invention.

In the simple form of the invention, the recess of the first wall may be dispensed with.

IN THE DRAWINGS

There now follows a description of a preferred embodiment of the invention, by way of example, with reference being made to the accompanying drawings, in which.

DESCRIPTION OF THE PREFERRED EMBODIMENTS

Figure 3:
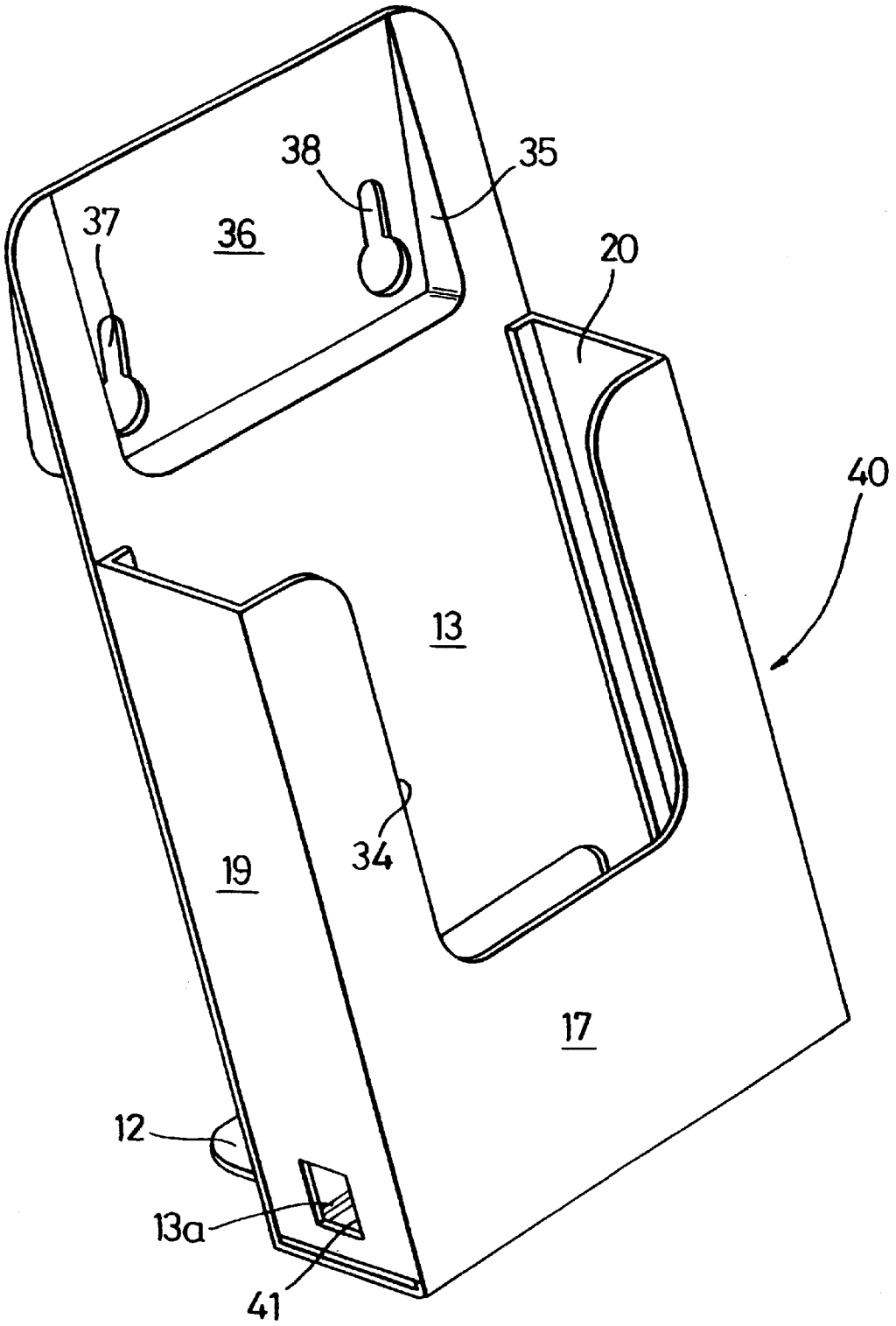
FIG. 3 is a perspective view of a receptacle according to the invention in its erect form.

Referring to the drawings there is shown a blank 10 for forming a receptacle 40 (FIG. 3). Blank 10 is substantially planar, and in the embodiment shown, is molded from a plastics material such as clear or opaque acrylic. Other materials for forming the blank 10 may be used. Examples include timber and sheet metal.

Blank 10 comprises a rigid base 11 of general rectangular shape. Base 11 includes projecting therefrom a rigid rectangular member 12. Member 12 extends from on longitudinal edge 11*a* of base 11 and is in the embodiment shown parallel to base 11. Member 12 is formed integrally with base 11. The length of member 12 parallel to longitudinal edge 11*a* is less than that of longitudinal edge 11*a*, and member 12 is equi-spaced from the ends of edge 11*a*. Thus, edge 11*a* is in effect two edge portions at either end of one side of base 11.

Edge portions 11*a* are hingedly secured to a corresponding pair of edge portions 13*a* of a rear wall 13. When the blank 10 is formed, for example, by molding, a hinge 14 may be separately applied for example by adhesive bonding at each pair of edge portions 11*a*, 13*a*.

Figure 1:
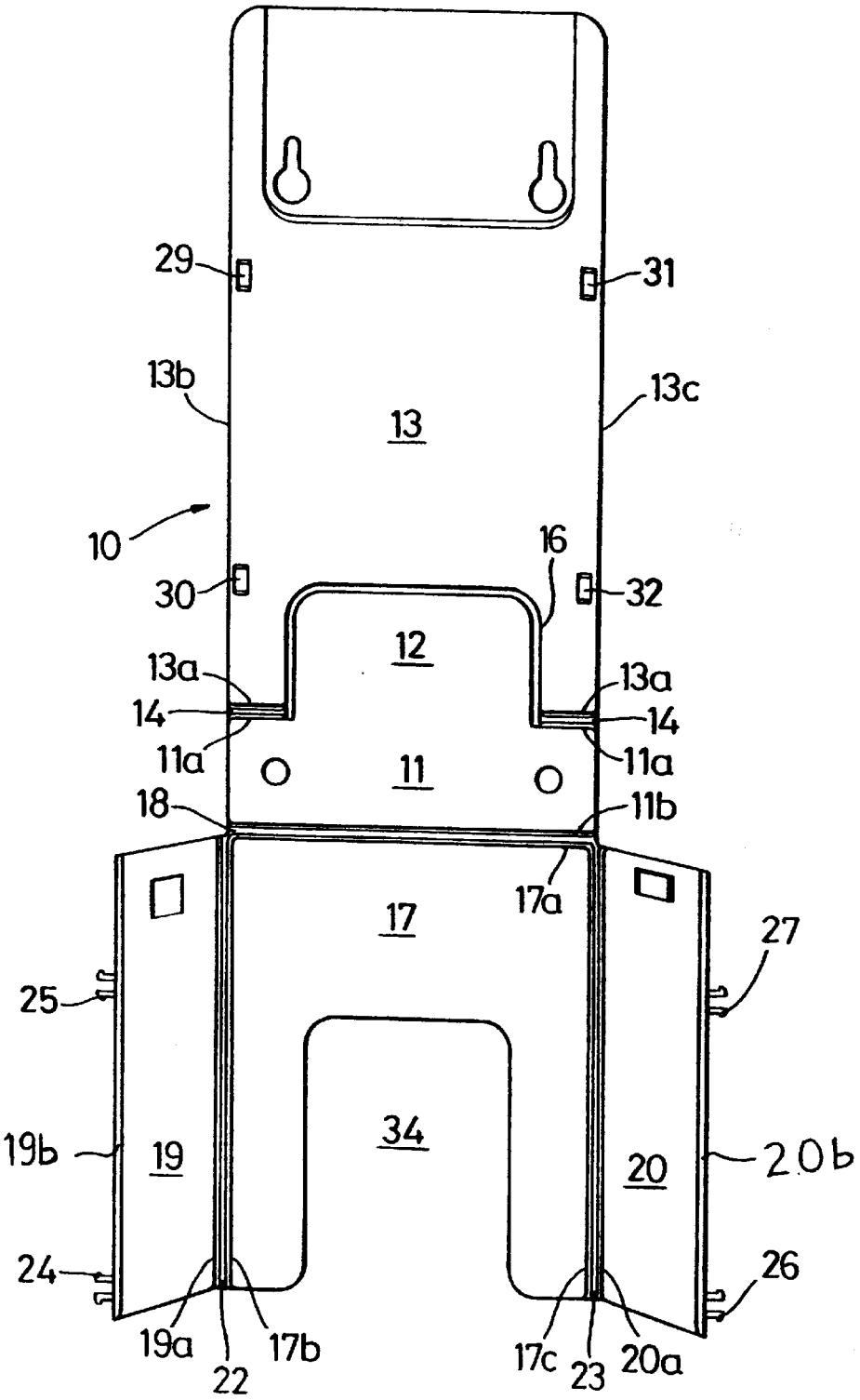
FIG. 1 is a plan view of a blank for forming a receptacle according to the invention.

The portion of rear wall 13 adjacent edge 13*a* includes a cut-out or recess 16 for receiving member 12 when the blank occupies its flat, unfolded configuration shown in FIG. 1.

Recess 16 is through-going in the embodiment shown. In alternative embodiments the recess 16 may extend for only part of the thickness of rear wall 13, preferably so as to permit hinging of member 12 downwardly relative to wall 13 on folding up of the blank to form a receptacle 40. In some embodiments the recess 16 may be dispensed with.

The longitudinal edge 11*b* of base 11 that lies opposite edge 11*a* is hingedly secured to an edge 17*a* of a front wall 17. Front wall 17 is of the same width as base 11 in the direction of edge 11*b*. The edges 11*b* and 17*a* are interconnected by a further hinge 18 that in the embodiment shown is a strip of flexible, plastics material formed integrally with the blank 10. The hinge 18 may alternatively be separately applied, as aforesaid.

The edges 17*b*, 17*c* of front wall extending perpendicular to edge 17*a* are respectively hingedly secured to the adjacent longitudinal edges 19*a*, 20*a* of parallelogram-shaped side walls 19, 20, by means of similar strip-like hinges 22, 23.

The free, longitudinal edges 19*b*, 20*b* of side walls 19, 20 each have projecting therefrom upper and lower barbed projection 24, 25, 26, 27 that are receivable in corresponding, rectangular apertures 29, 30, 31 32 formed in rear wall 13, adjacent the face longitudinal edges 13*b*, 13*c* thereof.

Front wall 17 has formed therein a through-going cutout 34 that in the embodiment shown is rectangular, although other shapes are possible. The cutout 34 serves to enhance the display of articles in receptacle 40.

Figure 2:
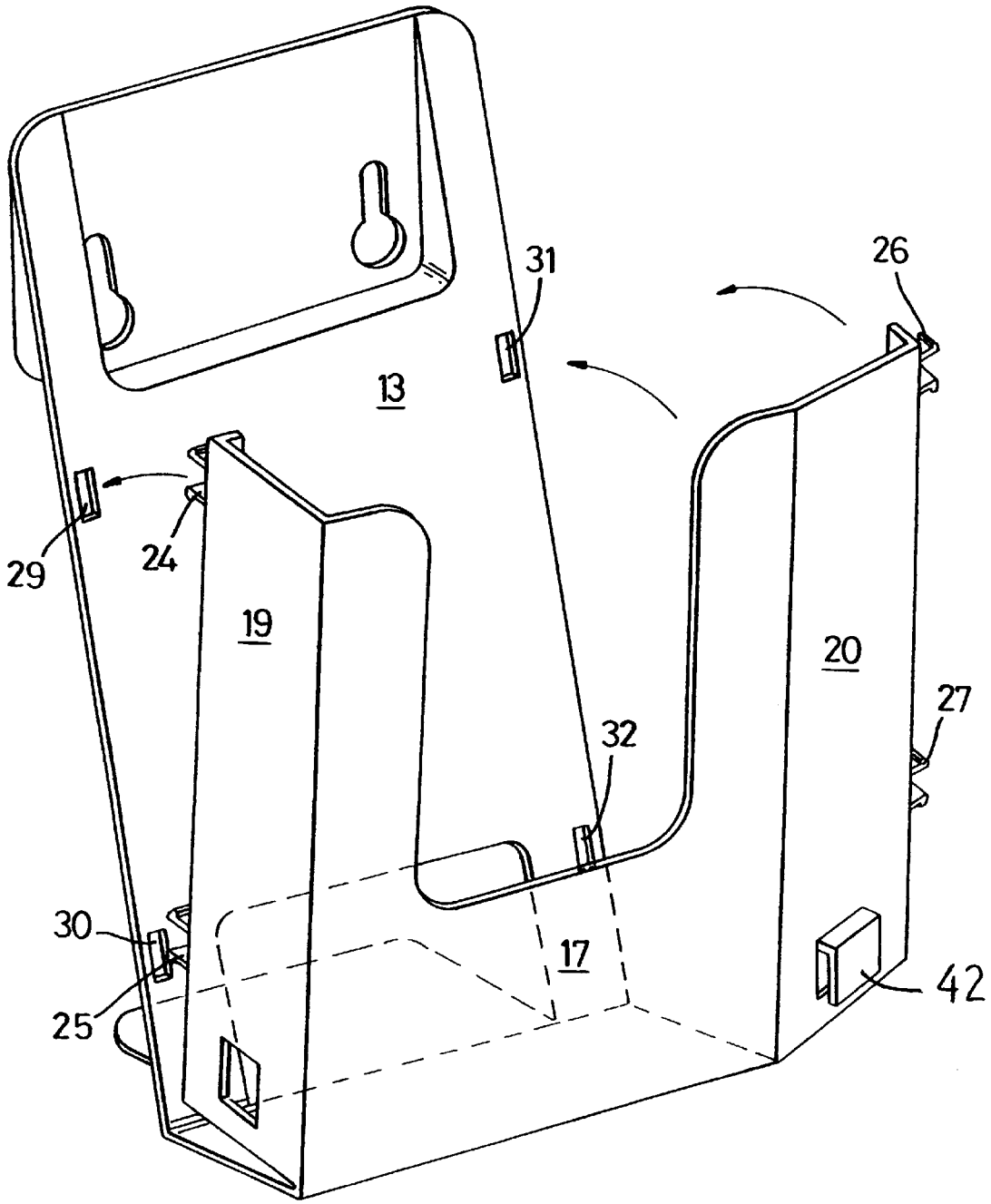
FIG. 2 is a perspective view of the blank of FIG. 1 partly folded up.

As shown in FIG. 2, erection of the blank 10 to form receptacle 40 involves hinging rear wall 13 upwardly relative to base 11, about hinge 14. Front wall 17 is then hinged upwardly relative to base 11 about hinge 18 and side walls 19, 20 are simultaneously hinged inwardly about hinges 22, 23 until the side walls 19, 20 lie generally perpendicular to front wall 17.

This action brings the barbed projections 24, 25 26, 27 into engagement with the corresponding apertures 29, 30, 31, 32 so that the barbs on the projections can be snap-fitted through the apertures to engage the rear surface of the rear wall 13, thereby conferring rigidity on the erected receptacle 40.

The projections 24, 25, 26, 27 are resiliently secured to the side walls 19, 20 so that the barbs thereon can be snap-released to allow collapsing of the receptacle.

As shown in FIG. 3, the erected receptacle 40 is useable as a free-standing item having an elongate, hollow recess open at its upper end for receiving and dispensing of articles. When free standing, receptacle 40 is supported on base 11 and member 12, which latter in use extends rearwardly of the receptacle, beyond the lowermost edge 13*a* of rear wall 13.

The parallelogram shape of each side wall 19, 20 means that the front wall 17 and rear wall 13 lie parallel to one another and are slightly inclined rearwardly from a normal to base/member combination 11, 12. This permits slight "fanning" of articles in the receptacle, making the articles easier to remove from the receptacle and rendering the display of articles more attractive.

Rear wall 13 is longer than the walls 17, 19, 20 whereby to support long articles in the receptacle. This feature in conjunction with the aforesaid inclination of the walls 13, 17 and the cut-out 34 gives an eye-catching display, even when the receptacle 40 is manufactured from an opaque material.

The upper end of rear wall 13 includes a rearwardly extending depression 35 that includes a wall portion 36 extending in a direction substantially normal to base/member combination 11, 12. Wall portion 36 includes formed therein a pair of horizontally spaced, through-going keyhole slots 37, 38 of conventional design. By virtue of the inclination of wall portion 36 relative to rear wall 13, when the receptacle 40 is suspended via the keyhole slots 37, 38 rear wall 13 (and hence front wall 17) is inclined relative to the normal to base 11 at the same angle as when the receptacle 40 is free standing.

Member 12 projects rearwardly in use of the receptacle far enough to ensure that receptacle 40 is stable when free standing, and also to support the lower portion of receptacle 40 and space the said lower portion from a vertical wall adjacent which receptacle 40 is suspended via the keyhole slots 37, 38. Thus member 12 ensures that receptacle 40 adopts the correct angle when so suspended.

Wall 19 has formed therein a through-going, rectangular aperture 41 and wall 20 has projecting outwardly therefrom a downwardly directed hook 42 that lies at the same height as aperture 41. Thus it is possible to link a plurality of the receptacles 40 together in a line, by virtue of engagement of the hook 42 of one receptacle 40 with the aperture 41 of an adjacent receptacle 40.

What is claimed is:

1. A collapsible receptacle comprising a base having a plurality of walls upstanding relative thereto and linked to one another to define a recess open on one side for receipt and dispensing of articles; the receptacle being formed from a blank in which the base is hingedly secured to at least a first wall, the base including formed rigidly integrally therewith a member that in use projects from the base beyond the hinge, the first wall including a recess for receiving the member when the first wall and the base lie parallel to one another and the receptacle including one or more interconnecting walls rigidly interconnecting, on erection of the receptacle, the first wall, and a third wall, the one or more interconnecting walls having a bottom edge at an obtuse angle relative to the adjacent upstanding first and third walls whereby the first and third walls are, in use of the receptacle, inclined relative to the vertical.

2. A collapsible receptacle according to claim 1 wherein the base is hingedly secured to the third wall, the third wall lying generally opposite the first said wall in use of the apparatus.

3. A collapsible receptacle according to claim 1 wherein the base is hingedly secured to the third wall, the third wall lying generally opposite the first said wall in use of the apparatus and wherein the one or more interconnecting walls are a second wall, and a fourth wall opposite the second wall, the second and fourth walls interconnecting the first and third walls in use of the receptacle.

4. A collapsible receptacle according to claim 1 wherein the base is hingedly secured to the third wall, the third wall lying generally opposite the first said wall in use of the apparatus; and wherein the one or more interconnecting walls are a second wall, and a fourth wall opposite the second wall, the the second and fourth walls interconnecting the first and third walls in use of the receptacle; and wherein the second and fourth walls are respectively hingedly secured to the one of the first and third walls; and releasably securable to the other of the first and third walls.

5. A collapsible receptacle according to claim 1 including suspension means disposed above the said member in use of the receptacle to permit suspension of the article with the member engaging a surface to space the base from the said surface.

6. A collapsible receptacle according to claim 1 including suspension means disposed above the said member in use of the receptacle to permit suspension of the article with the member engaging a surface to space the base from the said surface and wherein the suspension means is spaced from the first wall and the said member extends beyond the hinge between the base and the first wall in the direction of spacing of the suspension means from the first wall.

7. A collapsible receptacle according to claim 1 including one or more connectors for linking a plurality of the receptacle together.

8. A collapsible receptacle according to claim 1 including one or more connectors for linking a plurality of the receptacles together and wherein the one or more interconnecting walls are a second wall, and a fourth wall opposite the second wall, wherein the connector includes a hook-like projection protruding from one of the second and fourth walls and a recess, for receiving a hook-like projection, formed in the other of the second and fourth walls.

9. A collapsible receptacle according to claim 1 wherein the base is hingedly secured to the third wall, the third wall lying generally opposite the first said wall in use of the apparatus; and wherein the one or more interconnecting walls are a second wall, and a fourth wall, the second and fourth walls interconnecting the first and third walls in use of the receptacle, wherein the second and fourth walls lie opposite one another in use of the receptacle.

10. A collapsible receptacle according to claim 1 wherein at least one of the walls includes a recess for displaying articles stored therein.

11. A collapsible receptacle according to claim 1 wherein the first wall stands up relative to the base further than the remaining walls.

12. A blank for forming a receptacle, the blank including a first wall having a base hingedly secured thereto, the base including rigidly integrally formed therewith a member extending therefrom, and the first wall including a recess for receiving the member, thereby permitting hinging of the first wall and the base so that the member lies in the recess; and the blank including a third wall having hingedly secured thereto an interconnectable second wall for rigidly engaging the first wall, the interconnectable second wall having a bottom edge at an obtuse angle to its adjacent free edge to define a recess that in use is inclined relative to the vertical.

13. A blank according to claim 12 wherein the said member is generally coterminous with and parallel to the base.

14. A blank according to claim 12 including one or more further walls hingedly secured thereto for forming into a hollow recess open at one side for receipt and dispensing of articles.

15. A blank according to claim 12 including one or more further walls hingedly secured thereto for forming into a hollow recess open at one side for receipt and dispensing of articles and including one or more connectors for linking the said walls to one another to define the hollow recess.

16. A blank according to claim 12 including one or more further walls hingedly secured thereto for forming into a hollow recess open at one side for receipt and dispensing of articles.

17. A blank according to claim 12 including one or more further walls hingedly secured thereto for forming into a hollow recess open at one side for receipt and dispensing of articles wherein the third wall is hingedly secured to the base; and wherein the blank includes second and fourth walls hingedly secured to the third wall.

18. A blank according to claim 12 wherein the recess in the first wall is of complementary shape to the said member.

19. A collapsible receptacle according to claim 1 wherein each interconnecting wall is substantially parallelogram-shaped.

20. A blank according to claim 12 wherein each interconnectable wall is substantially parallelogram-shaped.

* * * * *